United States Patent [19]

Windedahl et al.

[11] Patent Number: 4,628,892

[45] Date of Patent: Dec. 16, 1986

[54] BOW AND STRING SILENCER

[75] Inventors: Alan L. Windedahl; Benedict M. Paczosa, both of Duncan, Nebr.

[73] Assignee: Saunders Archery Co., Columbus, Nebr.

[21] Appl. No.: 702,882

[22] Filed: Feb. 19, 1985

[51] Int. Cl.[4] ..... F41B 5/00

[52] U.S. Cl. ..... 124/23 R; 124/92; 124/DIG. 1

[58] Field of Search ..... 124/92, 90, 88, 87, 124/24 R, 23 R, DIG. 1

[56] References Cited

U.S. PATENT DOCUMENTS

| | | | |
|---|---|---|---|
| 1,885,962 | 11/1932 | Swenson | 124/90 |
| 2,608,188 | 8/1952 | Howard | 124/88 |
| 3,258,000 | 6/1966 | Kolpacki | 124/88 |
| 3,837,327 | 10/1974 | Saunders et al. | 124/92 |
| 4,116,194 | 9/1978 | Topel | 124/87 |

OTHER PUBLICATIONS

Fine-Line, Inc. Advertisement, May 1985.

*Primary Examiner*—Richard C. Pinkham
*Assistant Examiner*—Benjamin Layno
*Attorney, Agent, or Firm*—Henderson & Sturm

[57] ABSTRACT

A silencer for reducing the noise made by an archery bow wherein elastic members each have one end attached to a bow string at a point on the bow string spaced nearer to the outer end of the limbs than to the center nocking point of the string and also having the other end thereof secured to a respective adjacent limb at a point intermediate the ends of the limb.

11 Claims, 6 Drawing Figures

BOW AND STRING SILENCER

TECHNICAL FIELD

The present invention relates generally to archery bows, and more particularly to an apparatus for reducing the noise emanating from a bow when an arrow is shot therefrom.

BACKGROUND ART

It is well known that deer and other big game species have acute senses and lightning-quick reflexes. When hunting such game with a bow and arrow, it is not uncommon that such game will hear the noise from a bow when the arrow is released towards the animal, and the animal sometimes actually reacts quickly enough to move out of the way of the arrow before the arrow reaches such animal. Numerous solutions to this problem have been proposed over the years and the conventional approach to the problem has been to attach something to the string above the nocking point for the arrow and another identical structure below the nocking point, typically somewhat midway between the nocking point and the outer end of the string. U.S. Pat. No. 3,837,327 to Saunders et al shows one of the proposed solutions to this problem. Other prior art solutions have been to attach a plurality of short pieces of yarn and/or tying a bundle of short and narrow strips of flexible rubber to the string. While these prior art solutions have reduced the noise from bows to a great degree, the problem of deer or other game "jumping the string" as described above is still a problem because the noise has not been eliminated sufficiently.

In recent years, archery bow manufacturers have been producing and selling what is commonly referred to as a "cam bow", which is a name used in the art to describe a bow similar to the one shown in FIG. 1, but wherein the eccentrically mounted wheels on the end of the limbs are not circular when viewed from the side, but instead are of a different cam-like shape to cast the arrow with more force and speed. A universal problem with such cam-type bows is that they are noisy, as compared to similar bows using circular eccentrics. Despite the noise problem, these cam-type bows are in widespread usage because archers purchasing these bows have apparently decided that getting the extra speed of the arrow from these bows is more important to them than the quietness of the bow when shot. If these cam-type bows could be as quiet as other compound bows, then the hunting archer could have the best of both worlds.

Consequently there is a need for an improved bow and string silencer which is more efficient than the silencers presently available in the prior art.

DISCLOSURE OF THE INVENTION

The present invention relates to a silencer for reducing the noise made by an archery bow wherein elastic members are attached to a string at a point on the string spaced nearer to the outer end of the limbs than to the center nocking point of the string and also having the other end thereof secured to a respective adjacent limb at a point intermediate the ends of the limb.

An object of the present invention is to provide an improved bow and string silencer for an archery bow.

Another object of the invention is to provide an archery bow and string silencer which is more efficient than anything heretofore known.

A further object of the invention is to provide an archery bow silencer of the aforementioned type which connects not only to the string, but also to the limbs of such bow.

Other objects, advantages, and novel features of the present invention will become apparent from the following detailed description of the invention when considered in conjunction with the accompanying drawings.

BRIEF DESCRIPTION OF THE DRAWINGS

FIG. 3 also shows, in dashed lines, an optional string connected to the silencer and to a cable for preventing the silencer from becoming tangled;

BEST MODES FOR CARRYING OUT THE INVENTION

Figure 1:
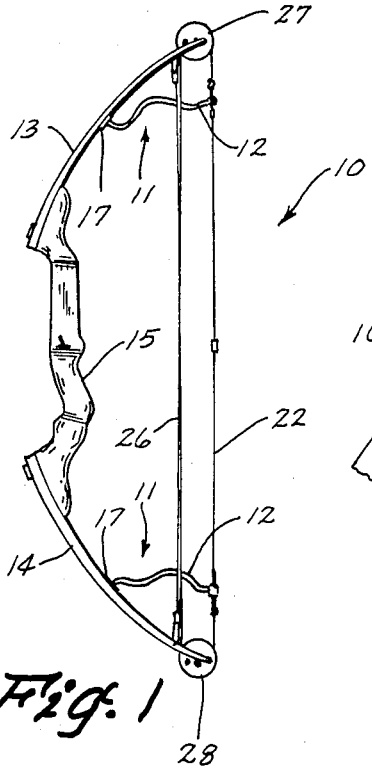
FIG. 1 is a side elevational view of a compound bow having a bow and string silencer constructed in accordance with the present invention attached thereto.
Figure 2:
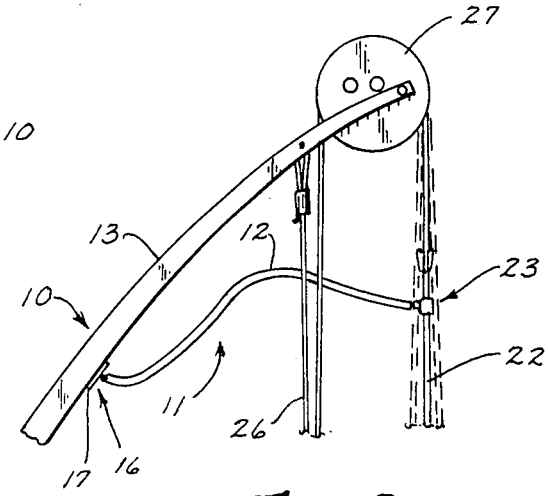
FIG. 2 is an enlarged, partial side view of one of the bow and string silencing devices shown in FIG. 1, and showing the string moving from a vibrational pattern shown in dashed lines to a stationary position shown in solid lines.

Referring now to the drawings wherein like reference numerals designate identical or corresponding parts throughout the several views, FIG. 1 shows an archery bow (10) of the compound type having silencers (11) constructed in accordance with the present invention attached thereto. Referring to FIG. 2, it is noted that the upper one of the silencers (11) shown in FIG. 1 has an elastic member (12) which is constructed of a tubular rubber which will stretch in length and then return to its original length when the pressure thereon is released.

Figure 5:
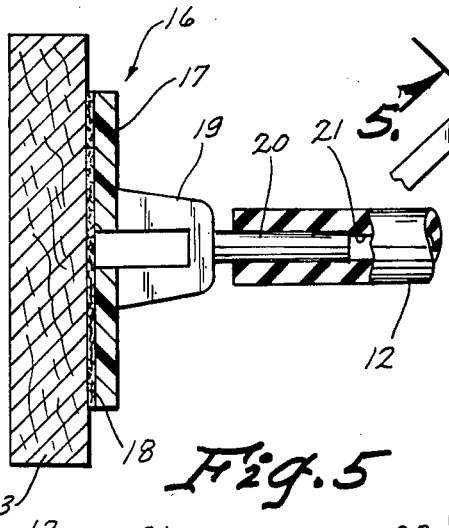
FIG. 5 is an enlarged, partial, cross sectional view taken along line 5—5 of FIG. 3.

The rubber tube (12) is connected to a top bow limb (13) by a securing fixture (16). This securing fixture (16) is attached to the limb (13) by an adhesive (18), as shown in FIG. 5, and preferably this adhesive (18) is attached to the base member (17) during the manufacturing process and a protective covering (not shown) is placed over the adhesive (18) so that once the fixture (16) is to be installed, the protective covering is removed and the base (17) is pressed against the limb (13) in the orientation shown in FIG. 5. This orientation is such that the intermediate connecter structure (19) can flex upwardly or downwardly as needed when the bow is drawn. A thin cylindrical portion (20) is adapted to be received within the opening (21) of the elastic or rubber member (12), as can be seen in FIG. 5. In the preferred embodiment, the fixture (16) is molded in one piece of flexible plastic.

Figure 4:
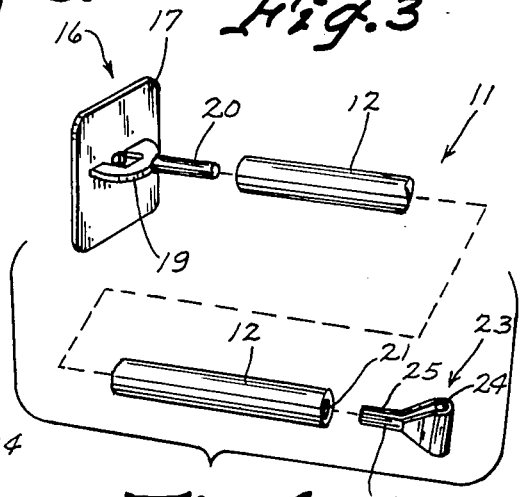
FIG. 4 is an enlarged, partial, exploded view of the present invention.
Figure 6:
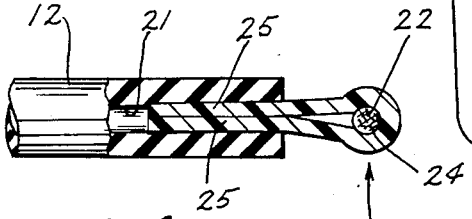
FIG. 6 is a partial, enlarged, cross sectional view taken along line 6—6 of FIG. 3.

The other end of the elastic member (12) is connected to the bow string (22) by an attaching structure (23)

which can be molded from the same type of material as the fixture (16). This string attaching structure (23) is initially in the position shown in FIG. 4, whereby it can be positioned over and onto the string whereby the string will be disposed within the opening (24). Then, outwardly extending members (25) can be pressed together and forced into the other end of the rubber tube (12), as shown in FIG. 6. The tight fit between the interior opening (21) of the rubber tube (12) and the members (25) holds the rubber tube (12) securely to the string (22).

Figure 3:
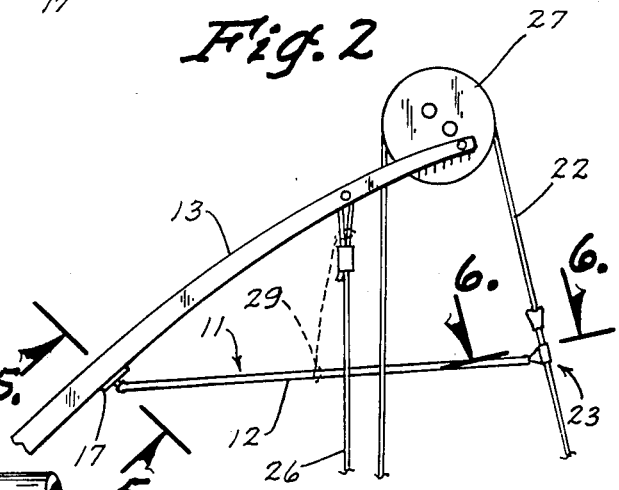
FIG. 3 is a view like FIG. 2, but showing the bow in a position of being drawn in preparation of shooting an arrow therefrom, and shows the position of the silencing device in such position as well.

Referring to FIG. 3, it is noted that an optional elastic or non-elastic string (29) is attached to a loop in the cable (26) and also to the elastic member (12). This optional string (29) can be utilized if the archer desires to use a longer elastic member (12) and, because of such additional length, something is needed to prevent tangling of such elastic member (12).

While one of the silencers (11) attached to either the top or the bottom of a bow will provide substantial noise reduction as compared to prior art structures, it is preferred that one of these silencers be attached to each end of the bow as shown in FIG. 1 to achieve optimum noise reduction.

Obviously many modifications and variations of the present invention are possible in light of the above teachings. For example the rubber tube (12) could be connected to the cable (26) instead of the string. Alternatively the rubber tube could be connected to both the cable (26) and the string (22), and achieve some additional dampening of the vibration of the string (22), especially since the cable (26) is connected to and is an extension of the string (22). It is therefore to be understood that, within the scope of the appended claims, the invention may be practiced otherwise than as specifically described.

I claim:

1. Archery apparatus comprising:

a bow of a type having a handle, flexible limbs attached to the handle and extending in opposite directions therefrom and a flexible string operatively connected at the ends thereof to the outer ends of said limbs whereby the string will have tension forces thereon due to forces applied thereto by the flexible limbs, said string having a somewhat centrally disposed nocking point thereof for receiving arrows thereon:

an elastic member;

means for attaching one end of said elastic member to said string at a point on the string spaced nearer to the outer end of one limb than to the center of said string, said one end of said elastic member being attached to said string at said point spaced nearer to the outer end of said one limb than to the center of the string;

means for securing the other end of said elastic member to said one limb at a point intermediate the ends of said one limb, said other end of said elastic member being attached to said one limb at a point intermediate the ends thereof by said securing means;

said elastic member being longer in an unstretched condition thereof than the straight distance between said point on the string and said point on said one limb in a relaxed condition thereof when said bow is undrawn and in said unstretched condition being shorter than the straight distance between said point on the string and said point on said one limb when the bow is drawn, thereby being stretched when said bow is drawn;

a second elastic member substantially identical to the first said elastic member;

second means for attaching one end of said second elastic member to said string at a point on the string spaced nearer to the outer end of the other limb than to the center of the string said one end of said second elastic member being attached to said string at said point on the string spaced nearer to the outer end of the other limb than to the center of the string by said second attaching means; and second means for securing the other end of said second elastic member to said second limb at a point intermediate the ends of said second limb, said second elastic member being attached at the other end thereof to the second limb at said point intermediate the ends of the second limb by said second securing means.

2. The apparatus of claim 1 wherein said elastic members comprises a rubber tube and said securing means comprises a connector base having an adhesive disposed thereon for attachment to said limb and a post attached to said connector base, said post being disposed in and frictionally held by one end of said rubber tube.

3. The apparatus of claim 2 wherein said attaching means comprises a flexible member folded around the string means and having ends adapted to be folded together and disposed in and frictionally held by the other end of said rubber tube.

4. The apparatus of claim 3 wherein said securing means includes means for allowing said post to pivot with respect to said connector base.

5. The apparatus of claim 1 wherein the first said elastic member, first said attaching means and the first said securing means are closer to the outer end of said one limb than to the centrally disposed nocking point of the string means, whereby vibrations of the string means and bow limbs will be dampened and thereby substantially silenced.

6. The apparatus of claim 1 including flexible line means for operably connecting an intermediate portion of said elastic means to the limb near the outer end thereof for preventing elastic member from becoming tangled.

7. The apparatus of claim 1 wherein said bow is of a compound type having eccentrically mounted members and said string means includes a cable extending over said eccentrically mounted members.

8. Archery apparatus comprising a bow of a type having a handle, flexible limbs attached to the handle and extending in opposite directions therefrom and a flexible string operatively connected at the ends thereof to the outer ends of said limbs whereby the string will have tension forces thereon due to forces applied thereto by the flexible limbs, said string having a somewhat centrally disposed nocking point thereon for receiving arrows thereon;

an elastic member, said elastic member comprising a rubber tube;

means for attaching one end of said elastic member to the string, said one end of the elastic member being attached to said string by said attaching means; and means for securing the other end of said elastic member to said one limb at a point intermediate the ends of said one limb, said other end of the elastic member being attached to said one limb by said securing means, said securing means comprising a connector base having an adhesive disposed thereon for attachment to said limb and a post attached to said connector base, said post being disposed in and frictionally held by said one end of said rubber tube, said securing means including means for allowing said post to pivot with respect to said connector base.

9. The apparatus of claim 8 wherein said attaching means comprises a flexible member folded around the string means and having ends adapted to be folded together and disposed in and frictionally held by the other end of said rubber tube.

10. A silencer for reducing the noise made by a bow of a type having a handle, flexible limbs attached to the handle and extending in opposite directions therefrom and flexible string means for operatively connecting the outer ends of said limbs whereby the string means will have tension forces thereon due to forces applied thereto by the flexible limbs, said string means having a somewhat centrally disposed nocking point thereon for receiving arrows thereon, said silencer comprising:

an elastic member, said elastic member comprises a rubber tube;

means for attaching one end of said elastic member to said string means at a point on the string means spaced nearer to the outer end of one limb than to the center of said string means, said attaching means comprising a flexible member foldable around the string means and having ends adapted to be folded together and disposed in and frictionally held by the other end of said rubber tube; and means for securing the other end of said elastic member to said one limb at a point intermediate the ends of said one limb, said securing means comprising a connector base having an adhesive disposed thereon for attachment to said limb and a post attached to said connector base, said post being disposed in and frictionally held by said one end of said rubber tube.

11. The silencer of claim 10 wherein said securing means includes means for allowing said post to pivot with respect to said connector base.

* * * * *